US007313341B2

(12) United States Patent
Matsusaka

(10) Patent No.: US 7,313,341 B2
(45) Date of Patent: Dec. 25, 2007

(54) IMAGE FORMING APPARATUS WITH ANOTHER SECONDARY POWER SUPPLY

(75) Inventor: Susumu Matsusaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 76 days.

(21) Appl. No.: 10/528,701

(22) PCT Filed: Aug. 5, 2004

(86) PCT No.: PCT/JP2004/011572

§ 371 (c)(1),
(2), (4) Date: Mar. 22, 2005

(87) PCT Pub. No.: WO2005/015321

PCT Pub. Date: Feb. 17, 2005

(65) Prior Publication Data

US 2006/0024078 A1 Feb. 2, 2006

(30) Foreign Application Priority Data

Aug. 8, 2003 (JP) ..... 2003-290108
Jul. 16, 2004 (JP) ..... 2004-209309

(51) Int. Cl.
*G03G 15/00* (2006.01)
*G03G 21/20* (2006.01)

(52) U.S. Cl. ..... 399/88; 399/90; 399/92

(58) Field of Classification Search ..... 399/70, 399/88, 90, 92, 94, 107, 328, 335
See application file for complete search history.

(56) References Cited

U.S. PATENT DOCUMENTS 4,574,188 A * 3/1986 Midgley et al. ..... 219/549
4,768,057 A 8/1988 Horiuchi et al.
5,561,499 A * 10/1996 Setoriyama ..... 399/90 X
5,907,745 A * 5/1999 Azuma et al. ..... 399/92
6,236,181 B1 * 5/2001 Baan ..... 318/500
6,415,118 B1 * 7/2002 Setoriyama et al. ..... 399/92
6,522,846 B2 * 2/2003 Kinouchi et al. ..... 399/90
6,847,795 B2 * 1/2005 Hirose et al. ..... 399/92
2002/0043523 A1 * 4/2002 Fujita et al. ..... 219/216
2002/0172536 A1 11/2002 Heath et al.
2003/0099479 A1 * 5/2003 Nakafuji et al. ..... 399/70

FOREIGN PATENT DOCUMENTS

JP 2000-184554 6/2000
JP 2000-315567 11/2000

* cited by examiner

*Primary Examiner*—Sandra L. Brase
(74) *Attorney, Agent, or Firm*—Oblon, Spivak, McClelland, Maier & Neustadt, P.C.

(57) ABSTRACT

An image forming apparatus including: a fixing unit; a main power supply that provides a portion of the heaters with voltage; and a secondary power supply that provides another portion of the heaters connected to the portion of the heaters in parallel with power provided by the main power supply. The secondary power supply is disposed below and in the neighborhood of the fixing unit. The secondary power supply may be disposed between a side face of a chassis of the image forming apparatus and the fixing unit, or at an exterior of the chassis of the image forming apparatus on the side face of the chassis. The secondary power supply can be prevented from being heated by the fixing unit.

29 Claims, 13 Drawing Sheets

IMAGE FORMING APPARATUS WITH ANOTHER SECONDARY POWER SUPPLY

TECHNICAL FIELD

The present invention generally relates to an image forming apparatus, and more particularly, to a fixing unit for fixing a toner image used for an image forming apparatus such as an electrophotographic copier, printer, and facsimile machine, for example.

BACKGROUND ART

Various methods to form an image on a recording medium such as plain paper and overhead projection film have been realized, and are used for copiers, printers, and facsimile machines, for example. Especially, electrophotography is widely employed for image forming apparatuses, because it can form an image of high quality at high speed, but its cost is low.

When an image is formed using electrophotography, generally, a toner image that has not been fixed yet is formed on a recording medium. Then, a fixing unit applies heat and pressure to the toner image thereby to fix the toner image on the recording medium. A heat roller method is widely used for the application of the heat and the pressure because the heat roller method is of high speed and safe. In the heat roller method, the recording medium passes through a pressure unit (hereinafter, referred to as a nip unit) formed by a heated fuser roller and a pressure roller that opposes the fuser roller so as to apply pressure to the fuser roller, and is heated and pressed.

The fuser roller is heated by a heating member such as a halogen heater to a temperature of about 180° C. at which the fuser roller is operable. The fuser roller is mainly a metal roller made of iron or aluminum, for example. The heating of the metal roller up to the operable temperature may take a long time (hereinafter, referred to as a rise time), for example, several minutes due to the high heat capacity of the metal roller. To avoid this problem, even when the image forming apparatus is idle (hereinafter, referred to as a standby time), the fuser roller is heated and kept at a temperature slightly lower than the operable temperature.

However, even while being kept at a temperature not as high as the operating temperature, the image forming apparatus consumes power that is not directly needed for its operation. According to a study, the power consumption needed during this standby period equals 70-80 percent of the total energy consumption of the image forming apparatus.

Recent consciousness of the need of environmental protection has triggered many countries to legislate various power saving regulations. In Japan, the amended power saving law becomes more severe. In the United States, regulations such as energy star and Zero Energy Star Mode (ZESM) have been enforced. It is desired that, during the standby period, the power consumption of the image forming apparatus approaches zero in order to comply with such regulations.

If the power consumption during the standby period is made zero, the image forming apparatus would require several minutes to make itself immediately operable. Then, a user needs to wait for a long period until the image forming apparatus becomes immediately operable. The image forming apparatus becomes unuseful. To avoid this problem, the fuser roller needs to be heated up quickly. For example, the above ZESM requires the rise time be less than 10 seconds.

The temperature of the fuser roller can be quickly increased by increasing the amount of energy given per the unit of time. A method to increase the amount of energy given per the unit of time is to make a power rating high. In the case of domestic offices, a power supply is rated as 100 V-15 A. This means that the power rating cannot be raised above 1500 W. Actually, an image forming apparatus that consumes 200 V input voltage for high speed printing is available. The use of such a high speed printing machine usually requires special arrangement on the power supply system from which the 200 V power is supplied to the image forming apparatus. Another method to increase the amount of energy give per the unit of time is to use two 100V-15 A power supplies. However, this method is practical only if there are two separate power adaptors close to the image forming apparatus.

Yet another method is proposed in which a secondary power supply is used to increase the maximum amount of power at the rise time. The secondary power supply is typically a rechargeable secondary battery such as a lead-acid cell and a nickel cadmium cell. If repeatedly charged and recharged, such a rechargeable battery is gradually degraded. In addition, if a great current is discharged, the life of a rechargeable battery is shortened. The nickel cadmium cell, which has a relatively long service life even if a great current is repeatedly discharged, can charge and discharge only at most 500-1000 times. If the nickel cadmium cell is assumed to be repeatedly charged and discharged twenty times a day, the nickel cadmium cell has only a one month service life. Furthermore, since the rechargeable battery of high capacity requires some hours to be charged, it is not practical to use the rechargeable battery for applications that require repeated charging and discharging within a day. Accordingly, the rechargeable battery cannot realize a practical secondary power supply.

In a reference document 1, a technique is disclosed in which a capacitor of great capacity such as an electric double layer capacitor is used as a second power supply. The electric double layer capacitor has two advantages. The first advantage is that the electric double layer capacitor can repeatedly charge and discharge more than several tens of thousands times. This means that there is substantially no limitation. Since the charging properties of the electric double layer capacitor degrade little, the electric double layer does not need to be replaced periodically. The second advantage is that the electric double layer capacitor can be charged for a short time period such as several to several tens of seconds. In addition, the electric double layer capacitor can flow a great current of several tens through several hundreds amperes. The electric double layer capacitor can be made ready to supply power.

That is, the electric double layer capacitor as a secondary power supply can supply power more than the limitation of the commercial power supply during a short rise time of several to several tens of seconds. Accordingly, a fixing unit of short rise time, high reliability, and high durability is realized.

A mechanism to take out great power is needed in order to exhaust the power stored in the capacitor of high capacity in the rise time of several to several tens of seconds. Since power=voltage×current, either the voltage or the current may to be increased.

The maximum current of a halogen heater that is used for heating the fuser roller is about 10-12 A. If a greater current is supplied, the life of the halogen heater is shortened. It is difficult to increase the maximum current. Accordingly, the power supplied to the halogen heater needs to be increased by making voltage high.

However, in the case in which water is used as the electrolyte, the voltage that a high-capacity capacitor cell can output is about 1 V, and even in the case in which organic solvent is used as the electrolyte, the voltage that a high-capacity capacitor cell can output is several volts. The voltage is kept low for preventing the electrolyte from being decomposited by electrolysis. If a great voltage needs to be supplied to the halogen heater, ten through several tens of cells need to be connected in series. In this case, even if a certain number of cells are enough to provide the halogen heater with sufficient energy, additional cells that are excessive energy-wise also need to be provided in order to increase the output voltage. This increases the cost of the power supply, and excessively increase the volume thereof.

To solve this problem, a reference document 2 proposes a method of obtaining great power at a low voltage by connecting a halogen heater to the high-capacity capacitor in parallel. According to this method, taking advantage of the fact that the high-capacity capacitor can flow a great current, great power is taken out at a low voltage in a short time period by setting the resistance of the halogen heater low. Thus, the cost of the capacitor power supply can be lowered, and the power supply can be made compact.

(Reference document 1) Japanese Laid-Open Patent Application No. 2000-315567

(Reference document 2). Japanese Laid-Open Patent Application No. 2000-184554

However, if the halogen heater is connected to the high-capacity capacitor in parallel, and a great current is flowed, wiring may cause a great loss as Joule heat. Since a great current flows through the wire, the wire needs to be very thick in order to reduce the loss as Joule heat. However, thick wire makes wiring in the image forming apparatus very difficult. The thick wire requires large space, and makes assembly difficult. On the other hand, if the wire is made short to reduce its resistance, the wire can be made relatively thin. As a result, wiring becomes easy, and it is possible to reduce space for wiring and to make assembly easy.

In the case of an electrophotography type image forming apparatus, the internal temperature often rises to 70-80° C. due to heat generated by the fixing unit and heat generated by the recent increase in power consumption of electric circuits. If the wiring is made short, the high-capacity capacitor and the fixing unit are disposed relatively close to each other. The environmental temperature of the high-capacity capacitor is increased due to the heat generation of the fixing unit.

In general, high-capacity capacitors such as electric double layer capacitors and pseudo capacitors called electrochemical capacitors have temperature ranges suitable for operation. For example, the operating temperature of a gold capacitor manufactured by Matsushita Electric Industries KK is about −25° C.-+60° C. The operating temperature of Lithium Ion Batteries and Nickel Hydrogen Batteries of the same manufacturer is, in the case of charging, 0° C.-+45° C., and in the case of discharging, −10° C.-+60° C. In addition, the durability of the high-capacity capacitors is degraded at an excessively high temperature. This degradation is thought to be caused mainly by the degradation of the internal electrolyte. Since the degradation of the durability of the electric double layer capacitors due to temperature increase is caused by chemical reactions, it is thought that, if the environmental temperature rises by 10° C., the speed of degradation becomes twice based on Arrhenius's equation.

If the wire is made short in order to reduce heat generation and power loss caused by a great current, the high-capacity capacitor and the fixing unit need to be disposed relatively close to each other. The high-capacity capacitor may be degraded due to the heat generated by the fixing unit, and as a result, the durability of the image forming apparatus may be degraded.

In addition, the fixing unit is rapidly heated in about 10 seconds by the secondary power supply using the high-capacity capacitor. If image forming is performed immediately after the fixing unit being made operable, little heat generated for the fixing unit has been transferred to the external cover or components near a fixation part of the fixing unit. They are almost at the same temperature. Moisture from paper passing through the fixation part is condensed by the components that are at the same temperature. The condensed moisture, if it forms water droplet and enters the circuit of the secondary power supply, may cause a short circuit or leak. In the case in which a non-water electric double layer capacitor using organic solvent as electrolyte is used as a charging element, if the water enters the capacitor cells through a relief valve or a junction part, the performance is considerably degraded. Since the secondary batteries use organic solvent, the entering of water into the secondary batteries cause considerable degrading of performance.

DISCLOSURE OF THE INVENTION

Accordingly, it is a general object of the present invention to provide an image forming apparatus in which the secondary power supply and the fixing unit are disposed close to each other, and temperature rise and moisture condensation can be prevented.

An image forming apparatus according to a first aspect of the present invention includes: a fixing unit that fixes a toner image transferred to paper, the fixing unit further having a plurality of heaters; a main power supply that provides a portion of the heaters with voltage; and a secondary power supply that provides another portion of the heaters connected to the portion of the heaters in parallel with power provided by the main power supply; wherein the secondary power supply is disposed below and in the neighborhood of the fixing unit. An image forming apparatus according to a second aspect of the present invention is characterized in that the secondary power supply is disposed between a side face of a chassis of the image forming apparatus and the fixing unit, or at an exterior of the chassis of the image forming apparatus on the side face of the chassis.

An image forming apparatus according to a third aspect of the present invention includes: a fixing unit that fixes a toner image transferred to paper, the fixing unit further having a plurality of heaters; a main power supply that provides a portion of the heaters with voltage; a secondary power supply that provides another portion of the heaters connected to the portion of the heaters in parallel with power supplied by the main power supply; and a paper feed unit to which a plurality of paper feed trays are loadable, the paper being stored in the paper feed trays; wherein the secondary power supply is disposed as a portion of the paper feed unit.

The image forming apparatus may further include an insulation member disposed between the fixing unit and the secondary power supply, or an insulation member disposed so as to cover the secondary power supply. The secondary power supply may further include a secondary power supply circuit and a capacitor, and the capacitor is covered by the insulation member. The image forming apparatus may further include: a first connection terminal provided on the chassis of the image forming apparatus; and a second connection terminal that is electrically connected to the second power supply, the second connection terminal being connectable to the first connection terminal. The first connection terminal and the second connection terminal may be detachable. The secondary power supply may further include: a capacitor of a high capacity; and a switch that switches on and off a ventilation unit for generating air flow in and around the secondary power supply. A wire of 14 or more in AWG size may be used for connecting the secondary power supply and the heaters. The secondary power supply may further include: a capacitor; and a discharging unit that discharges charge stored in the capacitor when the secondary power supply is maintained or replaced. The secondary power supply may further include a cooling unit that cools an interior of the secondary power supply.

In the case of an image forming apparatus according to the present invention, since the secondary power supply is disposed at a position at which the heat generated for the fixing unit does not affect the secondary power supply much, the capacitor configuring the secondary power supply is prevented from being heated to an excessive temperature by the heat. Because the secondary power supply is disposed close to the fixing unit, the wire can be made short, and the wiring becomes easy. At the same time, the electric power loss caused by the wire can be reduced. According to this arrangement, the durability and the efficiency of fixation can be improved. It is possible to provide a fixing unit of which rise time is very short without providing additional space in which the secondary power supply is disposed, and making the image forming apparatus larger. Accordingly, the durability of the secondary power supply and the efficiency of the fixing unit can be improved, and at the same time, the image forming apparatus can be made compact.

The insulation member prevents the capacitor from being heated to an excessive temperature by the heat generated by the fixation part. At the same time, the insulation member prevents moisture from being condensed. It protects the secondary power supply from dust generated by the image forming apparatus, and prevents a user from touching the secondary power supply. Furthermore, since the secondary power supply is made detachable, a storage unit can be easily set up, recovered, and maintained. It is possible to add the storage unit afterward to an image forming apparatus that has no secondary power supply. The image forming apparatus of which rise time is short using the secondary power supply can be configured. Since the discharging unit is provided, the charge charged in the capacitor can be safely discharged. This makes the setup, recovery, and maintenance of the secondary power supply safe. In addition, since the switch is provided that turns on and off the connection between the secondary power supply and the cooling unit, the charge charged in the capacitor can be safely discharged, and this makes the setup, recovery, and maintenance of the secondary power supply safe. Since the secondary power supply is provided with the cooling unit, the capacitor can be prevented from being heated to an excessive temperature by the heat generated by the fixation part. At the same time, the cooling unit can avoid moisture condensation.

Other objects, features, and advantages of the present invention will become more apparent from the following detailed description when read in conjunction with the accompanying drawings.

BEST MODE FOR CARRYING OUT THE INVENTION

Figure 1:
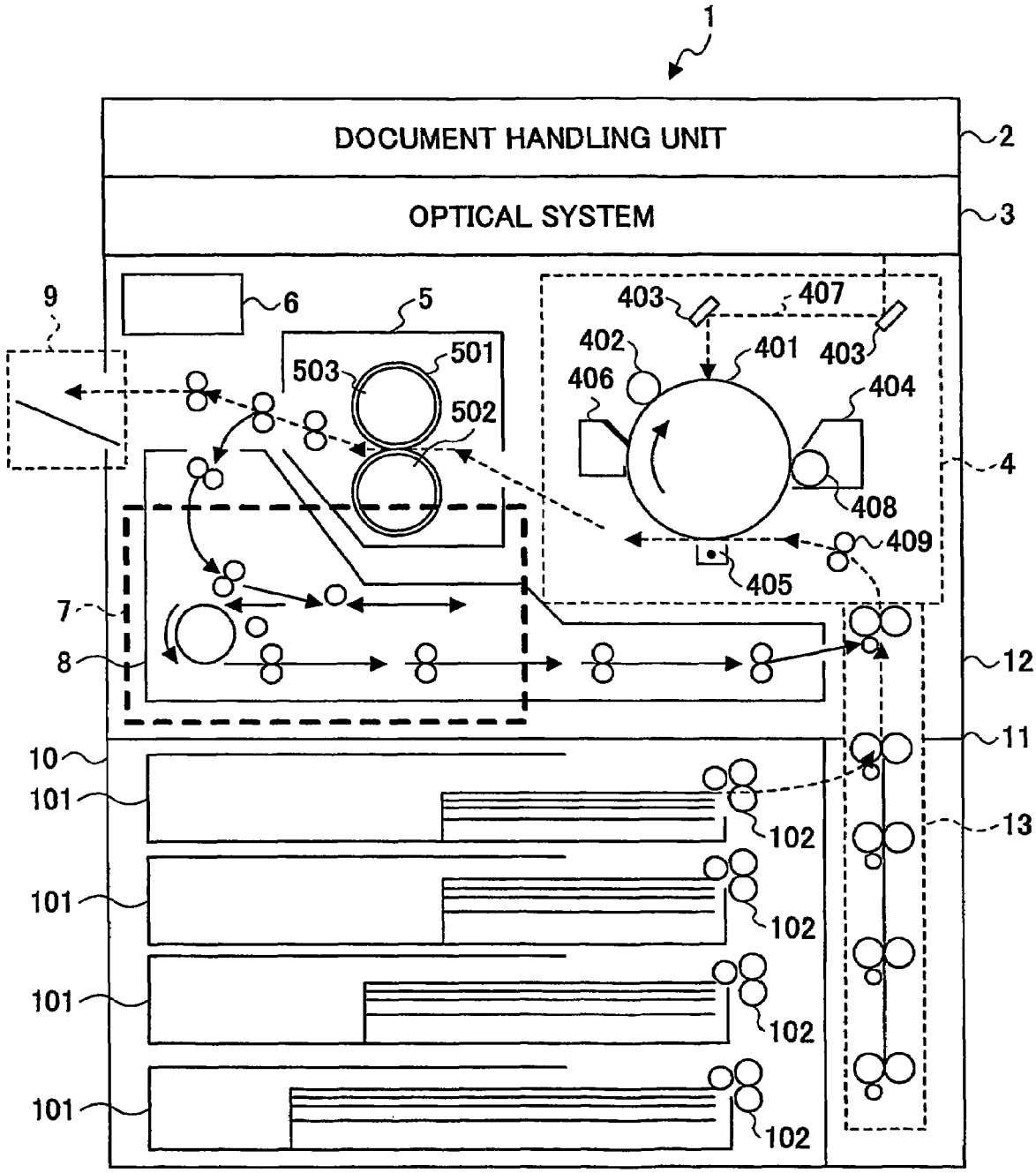
FIG. 1 is a schematic diagram showing an image forming apparatus according to an embodiment.
Figure 2:
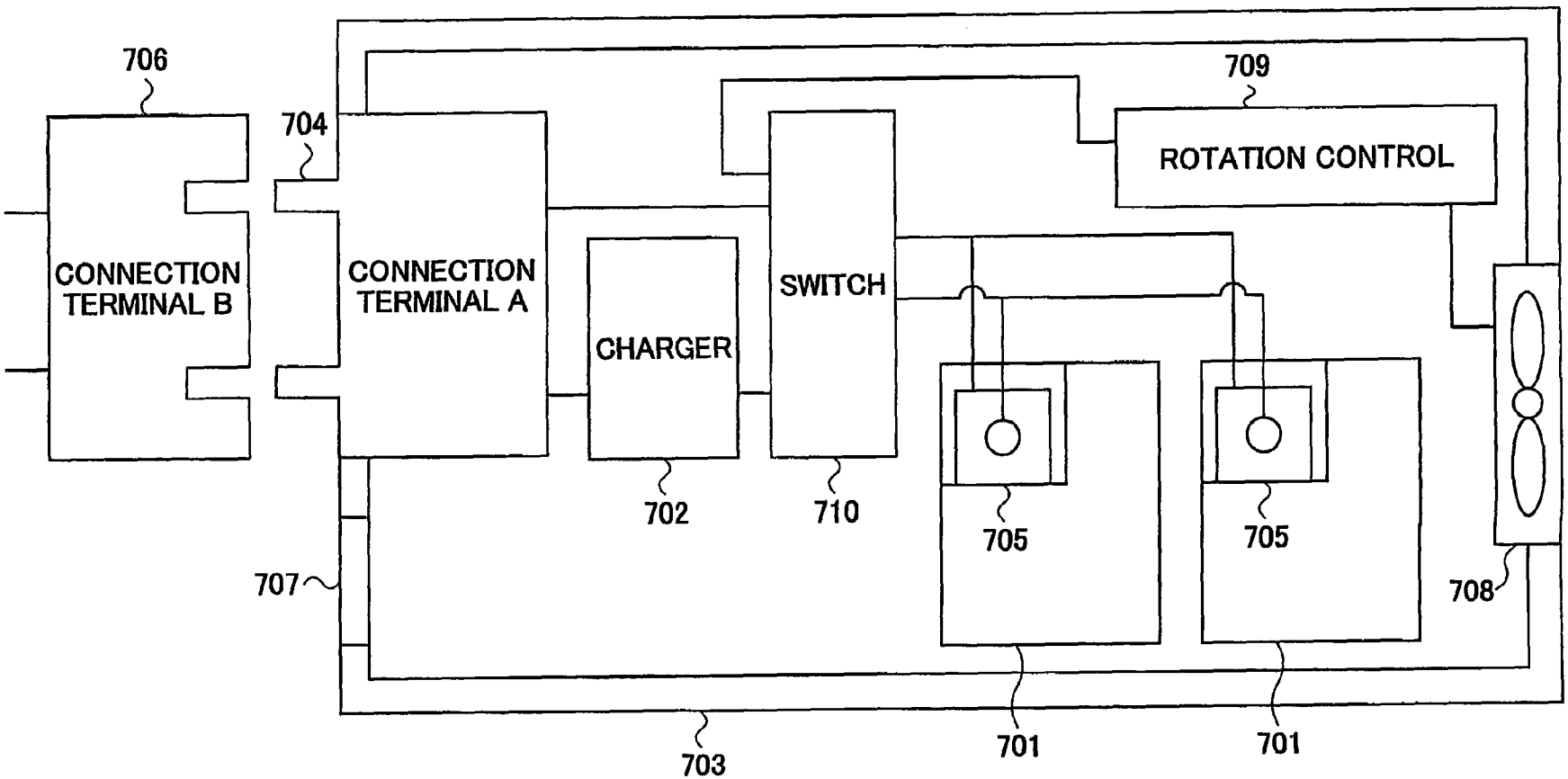
FIG. 2 is a block diagram showing a secondary power supply according to an embodiment.

The configuration of an image forming apparatus 1 according to a first embodiment is shown in FIG. 1. The image forming apparatus 1 is tall so that a user can dispose it on the floor and use it comfortably. The image forming apparatus 1 is provided with the following: a document handling unit 2 for transporting documents; an optical system 3 for applying light to the document transported by the document handling unit 2 and reading images; an image forming unit 4 for transferring the image read by the optical system 3 to a recording member such as paper; a fixing unit 5 for fixing the transferred image to the recording member; a main power supply 6 for supplying electric power to the entire apparatus; a secondary power supply 7 charged by the main power supply 6 for supplying electric power to the fixing unit 5; a reversing unit 8 for reversing the front and back of the recording member when an image is transferred and fixed on the front and the back of the recording member; a discharging unit 9 for discharging the recording member on which the image has been fixed to an exterior; a paper feed unit 10 for storing recording members and feeding the recording members to the image forming unit 4; a partition plate 11 for partitioning internal space, a chassis 12 that covers the above components; and a transportation path 13 for transporting the recording member output by the paper feed unit 10 or the reversing unit 8 to the image forming unit 4. The document handling unit 2, the optical system 3, the image forming unit 4, the fixing unit 5, the main power supply 6, the secondary power supply 7, the reversing unit 8, and the discharging unit 9 are disposed over the partitioning plate 11, and the paper feed unit 10 is provided under the partitioning plate 11. The partitioning plate 11 is parallel to the bottom face of the chassis 12. The partitioning plate 11 is made of resin, for example, as a part of the chassis 12.

The image forming unit 4 is provided with a photosensitive body 401 which is a drum-shaped rotative body. A charging roller 402, a mirror 403, a developing unit 404, a transferring unit 405, and a cleaning unit 406 are disposed around the outer periphery of the photosensitive body 401. When no light is applied to the photosensitive body 401, the charging roller 402 charges the surface of the photosensitive body 401 uniformly. The mirror 403 scans the charged photosensitive body 401 with exposure light 407, and forms an electrostatic latent image on the surface of the photosensitive body 401, the electrostatic latent image corresponding to an image to be formed on the recording member. The developing unit 404 forms a toner image by making the electrostatic latent image formed on the photosensitive body 401 visible using a developing roller 408. The transferring unit 405 transfers the toner image to a recording member such as paper by electric field. The cleaning unit 406 removes remaining toner that the transferring unit 405 left on the surface of the photosensitive body 401. The image forming unit 4 is provided with a resist roller 409. The resist roller 409 adjusts timing in which the recording member is transported so that the position of the toner image formed on the surface of the photosensitive body 401 and the position of the recording member match at the transferring unit 405. The recording member on which the toner image has been transferred by the transferring unit 405 is transported to the fixing unit 5.

Figure 7:
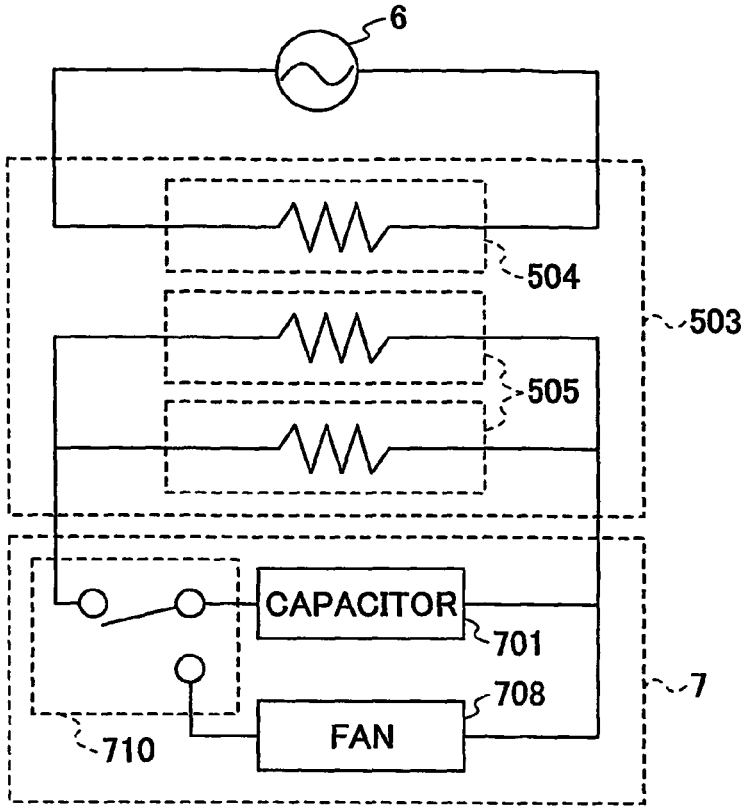
FIG. 7 is a circuit diagram of a heating unit and a secondary power supply according to an embodiment.

The fixing unit 5 receives the recording member on which the toner image has been transferred, from the image forming unit 4. The fixing unit 5 fixes the toner image on the recording member, and then, discharges the recording member to the discharging unit 9. The fixing unit 5 is provided with a fuser roller 501 for heating the recording member and a pressure roller 502 for applying pressure to the recording member. The fuser roller 501 is provided with, for example, a 0.7 mm thick aluminum metal core and a 0.02 mm thick fluoroplastic layer formed around the aluminum metal core metal. The diameter of the fuser roller 501 is about 40 mm. Because the heat capacity of the fuser roller 501 is very small, its temperature can be increased quickly. As shown in FIG. 7, the fuser roller 501 is provided with one main heating member 504 and two secondary heating members 505. The secondary heating member 505 is, for example, a halogen heater or a carbon heater.

Figure 4:
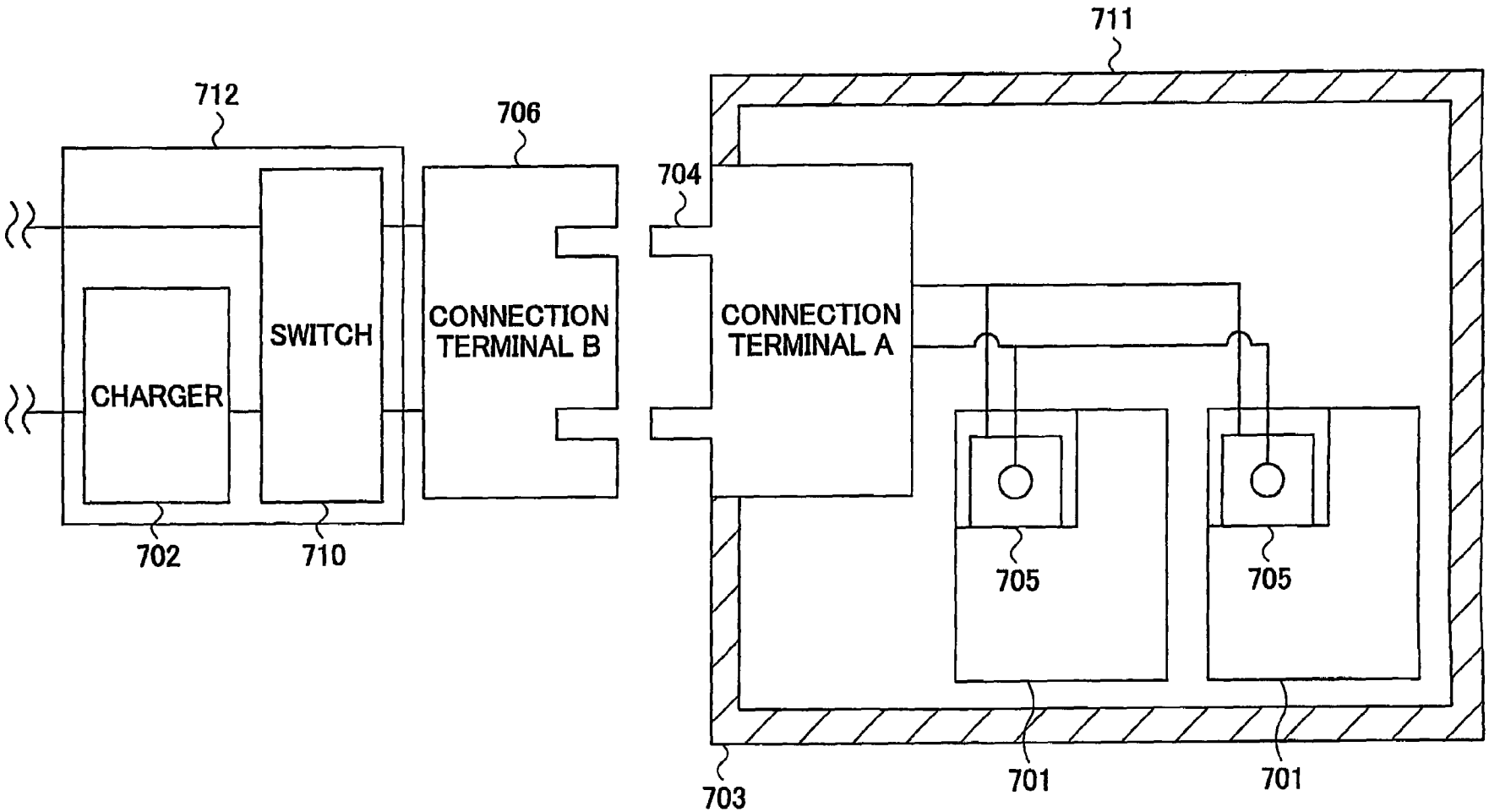
FIG. 4 is a block diagram showing another secondary power supply according to an embodiment.

The configuration of the secondary power supply 7 is shown in FIG. 4. The secondary power supply 7 is charged by receiving the supply of electric power from the main power supply 6, and provides the secondary heating member 505 (see FIG. 7) with electric power. The secondary power supply 7 is provided therein with a capacitor 701 and a charger 702, and is covered by a cubical insulation member 703.

The capacitor 701 is, for example, an electric double layer capacitor. The capacitor 701 is stored in the secondary power supply 7 in the form of a capacitor module including multiple capacitor cells. For example, the capacitor 701 is formed as a 90 V capacitor module including 36 pieces of 500 F, 2.5 V capacitor cells. The charger 702 charges the capacitor 701 using the electric power of the main power supply 6. The insulation member 703 is made of insulating material such as urethane foam system expandable resin. The insulation member 703 insulates the interior and the exterior of the secondary power supply 7. The insulating member 703 is preferably electrically insulating as well as thermally insulating so as to protect the user against electric shock.

From the viewpoint of cost, the insulating member 703 may be made of mold resin. The insulating member 703 may be covered by a metal plate such as aluminum or sheet metal so as to enhance the mechanical strength of the secondary power supply 7.

A connection terminal "A" 704 is electrically connected to electrode terminals 705 connected to the positive electrode and the negative electrode of the capacitor module. A connection terminal "B" 706 is attached at a position on the back face of the chassis 12 of the image forming apparatus 1, and is electrically connected to the secondary heating member 504 and the main power supply 6. The connection terminal "A" 704 and the connection terminal "B" 706 are shaped in a connectible manner so that the secondary power supply 7 can be detached to the image forming apparatus 1.

A ventilation aperture 707 on the insulating member 703 ventilates between the interior and exterior of the secondary power supply 7. A fan unit 708 provided to the insulating member 703 constitutes a ventilation unit. The fan unit 708 discharges air from the interior of the secondary power supply 7 to the exterior, and causes air to flow into the interior of the secondary power supply 7 through the ventilation aperture 707. Alternatively, the fan unit 708 causes air to flow from the exterior of the secondary power supply 7 into the interior thereof, and causes air to flow to the exterior of the secondary power supply 7 through the ventilation aperture 707. The air flow is adjusted so that the air flows along the capacitor 701. A rotation control unit 709 provided in the secondary power supply 7 controls the rotation of the fan unit 708 in accordance with the operation status of the image forming apparatus 1 so as to prevent the capacitor 701 from being excessively cooled.

In addition, the secondary power supply 7 is provided with a switch 710 that constitutes a switch unit. In the cases in which the electric power of the capacitor 701 is to be provided to the secondary heating member 505, in which the electric power of the capacitor 701 is to be provided to the fan unit 708, and in which the capacitor 701 is to be provided with electric power from the main power supply 6, the switch 710 is operated. When the image forming apparatus 1 is normally used, the electric power of the capacitor 701 is provided to the secondary heating member 505. On the other hand, when the capacitor 701 is to be maintained or replaced, the electric power of the capacitor 701 is provided to the fan unit 708 thereby to discharge the charge stored in the capacitor 701. The switch 710 and the fan unit 708 function as a discharging unit. When the capacitor is charged, the electric power of the main power supply 6 is provided to the capacitor 701 thereby to store electric power in the capacitor 701.

Figure 3:
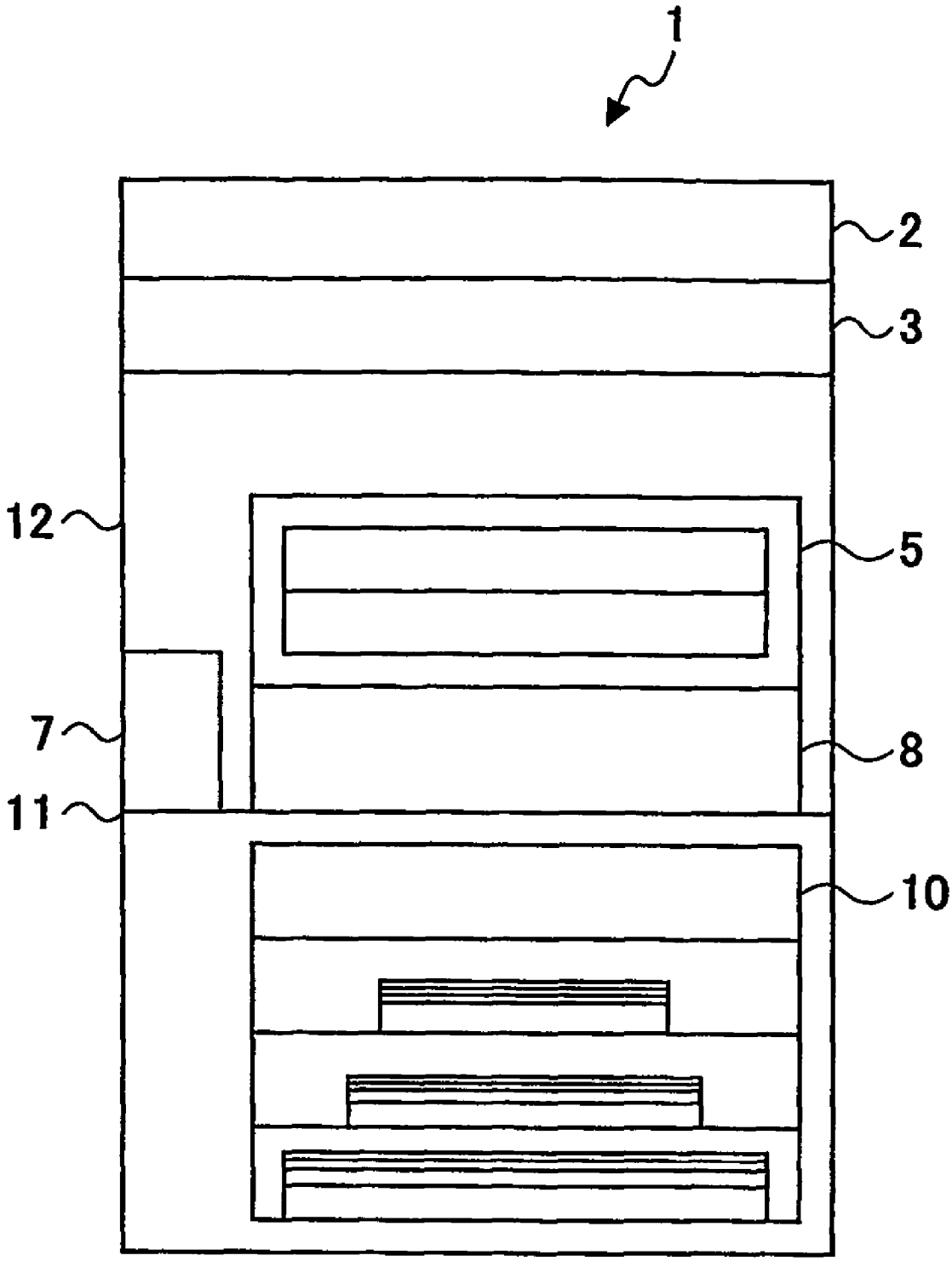
FIG. 3 is a schematic diagram showing the disposition of a secondary power supply according to an embodiment.

A position in the image forming apparatus 1 at which the secondary power supply 7 is disposed is shown in FIG. 3. The secondary power supply 7 is disposed in a space between the reversing unit 8 under the fixing unit and a back face wall that is a portion of the side face of the chassis 12. A portion of the insulating member 703 of the secondary power supply 7 may be configured with a portion of the chassis of the image forming apparatus 1. For example, the insulation member on the bottom face of the secondary power supply 7 may be replaced by a portion of the partitioning plate 11. In addition, the insulating member on a side face of the secondary power supply 7 may be configured with a portion of the back face of the chassis 12 of the image forming apparatus 1. If the portion of the insulating member 703 is replaced with the portion of the partitioning plate 11 or the chassis 12, for example, and the secondary power supply 7 is provided at a production stage, the connection terminals A 704 and B 706 may not need to be provided, and the secondary power supply 7 and the image forming apparatus 1 may be electrically connected directly. It is not necessary to cover the entire face of the secondary power supply 7 with the insulating member 703.

The ventilation aperture 707 is preferably disposed at a position more upstream than the fixing unit 5 in a direction in which the paper is transported so that the secondary power supply 7 can acquire cooler air. The ventilation aperture 707 and the fan unit 708 are preferably connected to the exterior of the image forming apparatus 1 in order to efficiently cool the secondary power supply 7.

If the ventilation aperture 707 is disposed at a position other than the position facing the fixing unit 5, hot air from the fixing unit is prevented from entering the secondary power supply 7. Additionally, moisture discharged from the paper by the heat of fixation is prevented from condensing at the insulating member, and as a result, the condensed moisture is prevented from entering the secondary power supply.

According to an experiment, when the image forming apparatus 1 was operated continuously, the temperature around the fixing unit 5 was 70° C. On the other hand, when the image forming apparatus 1 continuously operated, the temperature in the secondary power supply 7 was 50° C. without the operation of the fan unit 708, and 35-40° C. with the operation of the fan unit 708. A radiation plate may be provided to the capacitor 701 in order to efficiently cool the capacitor. For example, a Peltier element or an apparatus for circulating cooling agent using a pump may be used to cool the interior of the secondary power supply 7 instead of the fan unit 708 as the cooling unit.

The secondary power supply 7 may be separated into a capacitor module 711 and a secondary power supply circuit 712 as shown in FIG. 4. The capacitor module 711 includes only the capacitor 701 configured by the electric double layer capacitor covered by the insulating member 703. The secondary power supply circuit 712 includes the charger 702 and a switch 710. Since the electric double layer capacitor charges and discharges electricity by physical absorption and discharge in a different manner from the secondary battery, the capacitor 701 has low internal resistance and generate little heat. The major source of heat in the secondary power supply 7 is the charger, for example. Even if the ventilation aperture 707 and the fan unit 708 are not provided to the insulating member 703, the heat generated by a circuit member such as the charger 702 and the fixing unit 5 can be prevented from affecting the capacitor 701 by covering only the capacitor 701 with the insulating member 703. The capacitor 701 can be further prevented from being heated by using insulating material having a higher insulation effect such as a vacuum insulator as the insulating member 703.

Figure 5:
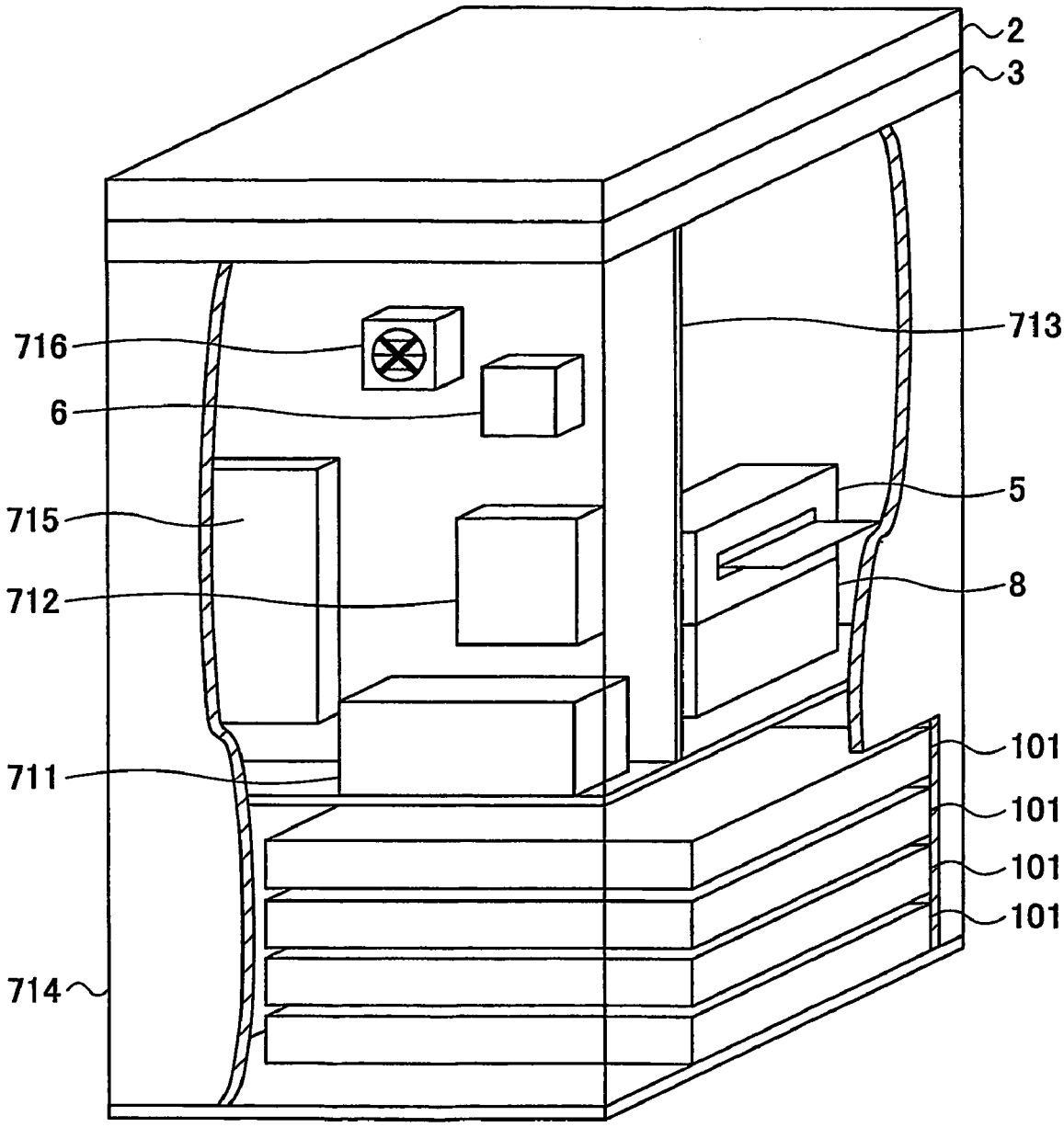
FIG. 5 is a schematic diagram showing the disposition of a secondary power supply according to another embodiment.

If the secondary power supply 7 is separated into the capacitor module 711 and the secondary power supply circuit 712, the secondary power supply 7 may be disposed in a space between the insulating member 713 and the back face wall 714 (see FIG. 5), the space being insulated from the fixing unit 5 by the insulation member 713. Since the capacitor module 711 is disposed at a lower position than the secondary power supply circuit 712, the heat generated by the secondary power supply circuit 712 is transferred upward. As a result, the capacitor module 711 is prevented from being heated. Since the insulating member 713 is provided between the fixing unit 5 and the secondary power supply 7, if the fixing unit 5 is rapidly heated immediately after the image forming apparatus is turned on, moisture condensation caused by the heat current flowing to the capacitor module 711 can be avoided.

Figure 6:
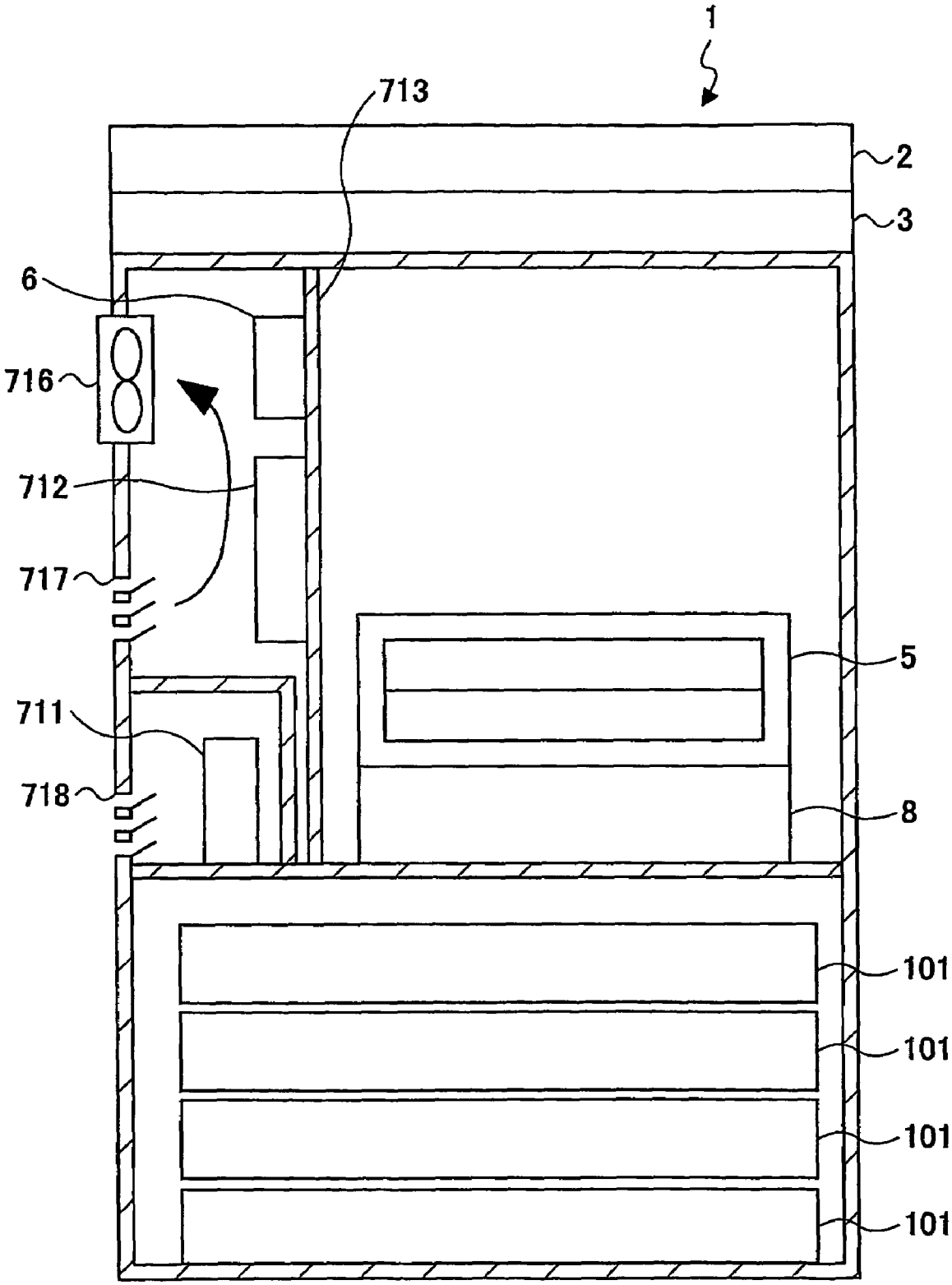
FIG. 6 is a schematic diagram showing the disposition of a secondary power supply according to yet another embodiment.

The main power supply 6 and a main body electric board 715 on which controllers including a CPU for controlling the image forming apparatus 1 and controller boards are provided in the space between the insulating member 713 and the back face wall 714. A fan 716 for cooling the CPU is provided at a upper portion of the space, the fan 716 piercing the back face wall 714. As shown in the side cross-sectional view in FIG. 6, since a ventilation aperture 717 is provided on the back face wall 714 below the secondary power supply circuit 712, air flows in through the ventilation aperture 717, rises along the insulating member 713 as indicated by an arrow, and flows out by the fan 716 thereby to cool the secondary power supply circuit 712. Because the fan 716 is used to cool the CPU, no fan needs to be provided in the secondary power supply 7. In addition, the capacitor 701 can be cooled by providing a ventilation aperture 718 on the insulating member 713 of the capacitor module 711.

A circuit diagram including the heating member 503, the main power supply 6, and the secondary power supply 7 is shown in FIG. 7. The main heating member 504 is provided with electric power from the main power supply 6. Two secondary heating members 505 are provided with electric power from the capacitor 701 provided in the secondary power supply 7. The thickness of wires connecting the secondary power supply 7 and the secondary heating member 505 may be appropriately selected in accordance with consideration of the easiness of assembly of the secondary power supply 7 and power loss as Joule heat. However, the wire is preferably thicker than AWG (American Wire Guage) 14 (about 1.628 mm in diameter). More preferably, the wire diameter is greater than AWG 12 (about 2.053 mm) and smaller than AWG 8 (about 3.264 mm). It is preferable that, if the secondary power supply 7 is disposed closer the fixing unit 5, the wire diameter is greater.

Figure 8:
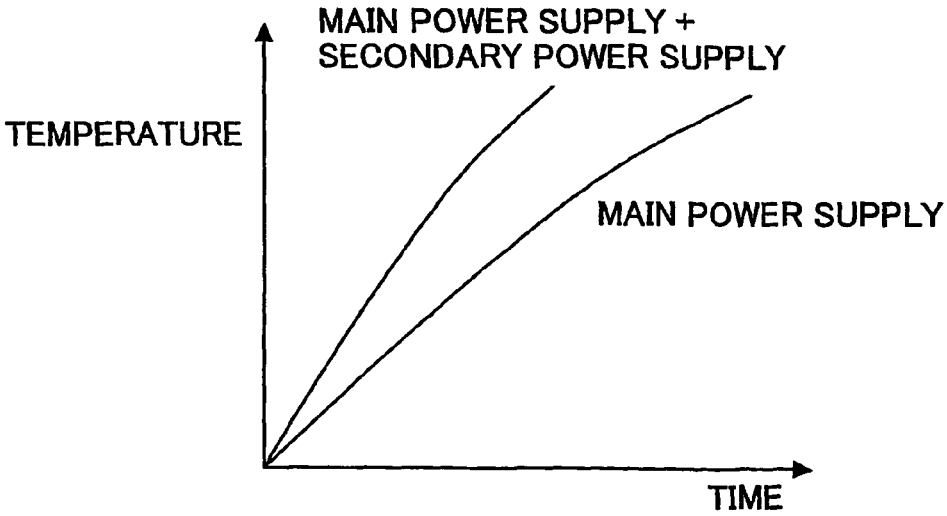
FIG. 8 is a graph showing the relation between the temperature of a heating member and time.

The heating member 503 can be provided with electric power by both the main power supply 6 and the capacitor 701 simultaneously. As a result, the heating member 503 can be provided with a greater amount of electric power than the power the main power supply 6 can provide alone. Accordingly, the temperature of the fixing unit can be increased in a shorter time period using both the main power supply 6 and the capacitor 701 together than the time period in which only the main power supply 6 is used. The relation between the temperature of the heating member 503 and time is shown in FIG. 8. In addition, the voltage output by the capacitor 701 is low. Although the capacitor 701 can provide only small electric power amounts to each secondary heating member 505, the total electric power provided by the capacitor 701 becomes great.

For example, in the case in which the voltage of the main power supply 6 is about 100 V, the voltage of the capacitor 701 is about 90 V, the resistance of the main heating member 504 is about 8 Ω, and the resistance of each halogen heater being the secondary heating member 505 is about 9.5 Ω, electric power of 850 W each can be taken out of the two secondary heating members 505, and electric power of 1200 W can be taken out of the commercial power supply connected to the main power supply 6. According to the above arrangement, electric power of about 2900 W that is more than the electric power of 1500 W which is the maximum electric power providable from the commercial power supply can be used to increase the temperature of the heating member 503. In this case, the surface temperature of the fuser roller can be increased from 20° C. to 180° C., which is the temperature at which the fixation is performed, in a very short time such as 10 seconds.

Figure 9A:
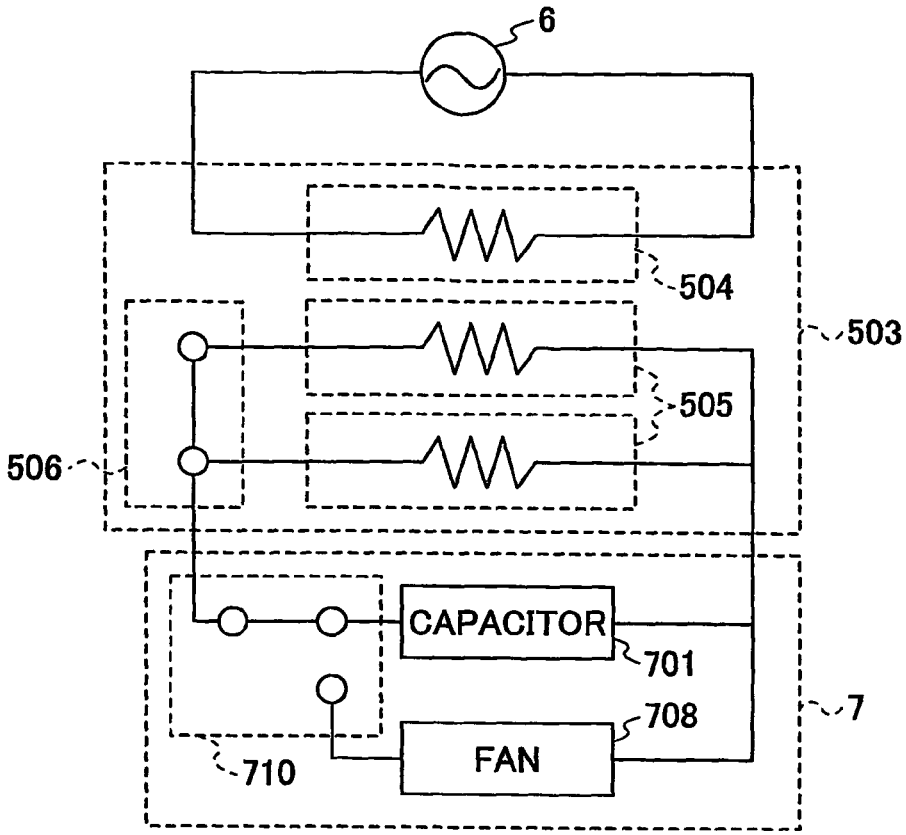
FIGS. 9A and 9B are circuit diagrams in which a switch for switching to a secondary power supply is provided.
Figure 9B:
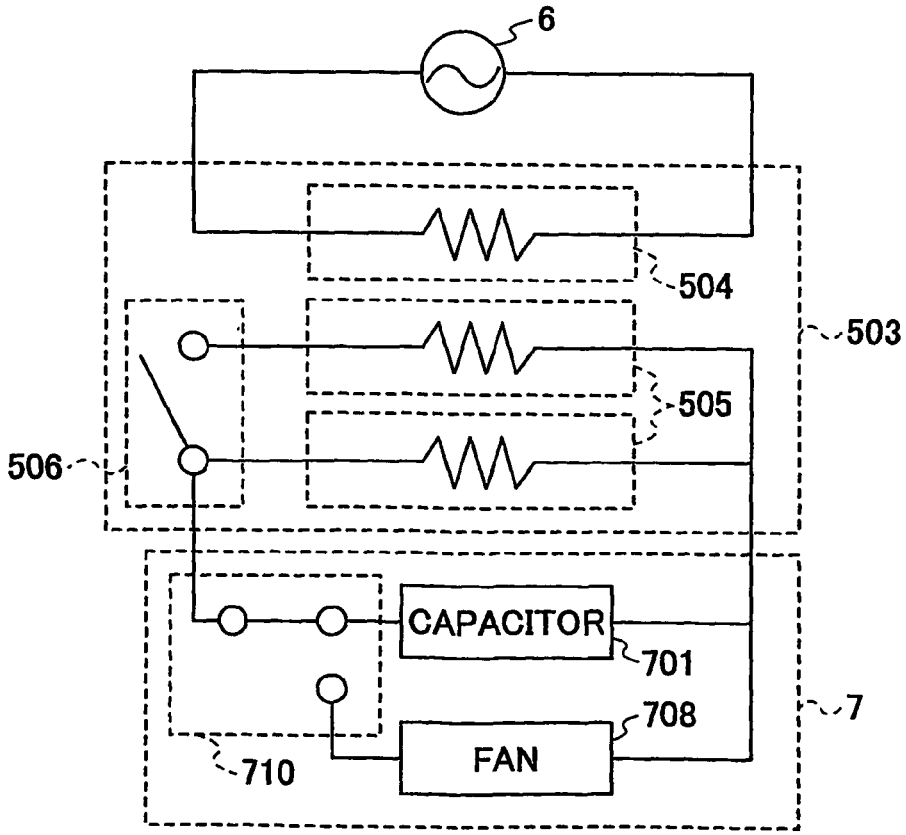

As shown in the circuit diagram in FIG. 9A, the main power supply 6 may provide the main heating member 504 with electric power, and the secondary power supply 7 may provide the two secondary heating members 505 with electric power. In this case, a selection may be made by a secondary heating member switch 506 of whether only one secondary heating member 505 is to be provided with electric power from the capacitor 701 or two secondary heating members 505 are to be provided with electric power from the capacitor 701. The fuser roller 501 is a roller having a thin aluminum metal core of which heat capacity is small. If many sheets of paper are printed continuously immediately after the image forming apparatus 1 is turned on, the temperature of the surface of the fuser roller 501 may become lower than a temperature that is required for fixation. This reduction in temperature needs to be avoided. The electric power required for continuous printing is relatively less than that required for starting up. Accordingly, the two secondary heating members 505 can be provided with electric power for starting up as shown in the circuit diagram in FIG. 9A. Then, only one secondary heating member 505 can be provided with electric power for continuous printing as shown in the circuit diagram of FIG. 9B. Since the number of secondary heating members 505 that are provided with electric power is determined by the secondary heating member switch 506, the amount of electric power can be adjusted for the starting-up and the continuous printing.

If halogen heaters, through each of which flows about 9.5 A current, are used as the secondary heating members 505, the total current becomes about 19 A. On the other hand, if more halogen heaters are connected in parallel, or if a carbon heater is used as the secondary heating member 505, the total current becomes more than 19 A. As a result, greater current flows, and greater electric power can be taken out. As is discharged, the voltage output by the electric double layer capacitor used as the capacitor 701 is reduced. The secondary heating member 505 may be a resistance heater that surely generates heat even if the supplied voltage is reduced.

In the case in which images are to be formed on both sides of a recording member, the reversing unit 8 (refer back to FIG. 1) receives the recording member discharged from the fixing unit 5 and selected by a branching nail, reverses the recording member by switch back reversing, and sends the recording member to a transportation path 13 connected to the resist roller 409.

The paper feed unit 10 is provided with paper feed trays 101 and paper feed rollers 102. The paper feed trays 101 store recording members of multiple sizes by the size. The paper feed rollers 102 take out the recording member stored in the paper feed tray 101 and send it to the transportation path 13. The recording member is transported through the transportation path 13 to the resist roller 409.

Since the major portion of heat generated by the fixing unit 5 is transferred upward by natural convection, it is not transferred into the secondary power supply 7. The heat transmitted and radiated downward from the fixing unit 5 is obstructed by the insulating member on the top face of the secondary power supply 7, and as a result, does not enter into the secondary power supply 7. Heat generated by various electronic circuit boards (not shown) provided around the back face wall of the image forming apparatus 1 is also obstructed by the insulating member 703, and as a result, does not enter the secondary power supply 7. That is, the capacitor stored in the interior of the secondary power supply 7 is insulated from various heat sources, and is prevented from being degraded by temperature increase. The secondary power supply 7 prevents any floating matter generated in the image forming apparatus 1 from entering the secondary power supply 7. For example, if toner scatters due to erroneous handling upon replenishment, the secondary power supply 7 can be prevented from being polluted, and as a result, the reliability of the image forming apparatus 1 is improved.

The ventilation aperture 707 and the fan unit 708 can prevent the temperature of the capacitor 701 from being increased by heat generated by an electric circuit constituting the secondary power supply 7 stored in the secondary power supply 7. If a radiation plate is provided on the capacitor 701, the cooling effect becomes more efficient. The rotation control unit 709 can prevent the capacitor 701 from being cooled too much by the fan unit 708, and at the same time. When the cooling is not needed, the rotation control unit 709 also reduces the power consumption of the fan unit 708.

Figure 10:
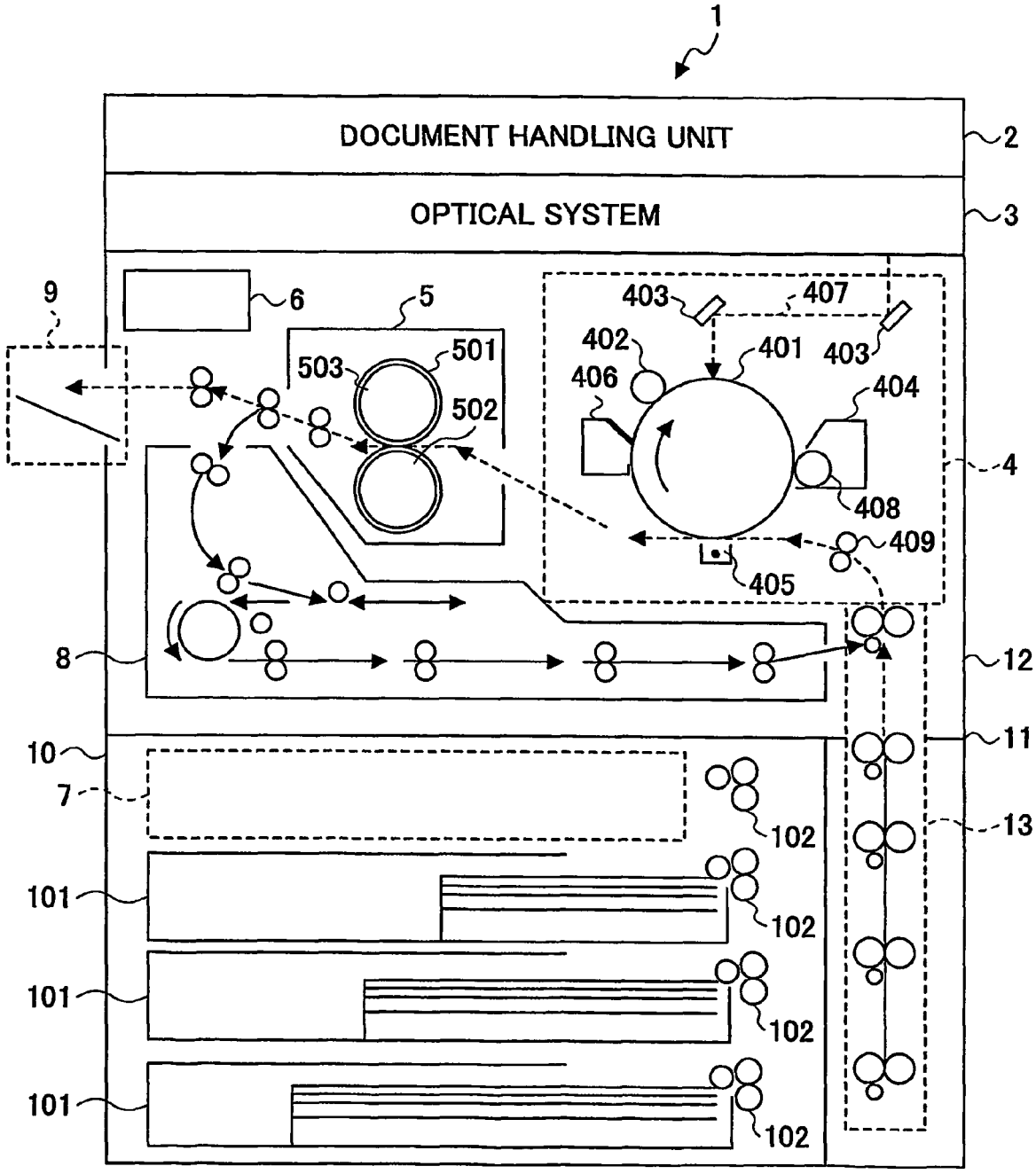
FIG. 10 is a schematic diagram showing the disposition of a secondary power supply in a paper feed unit according to an embodiment.
Figure 11A:
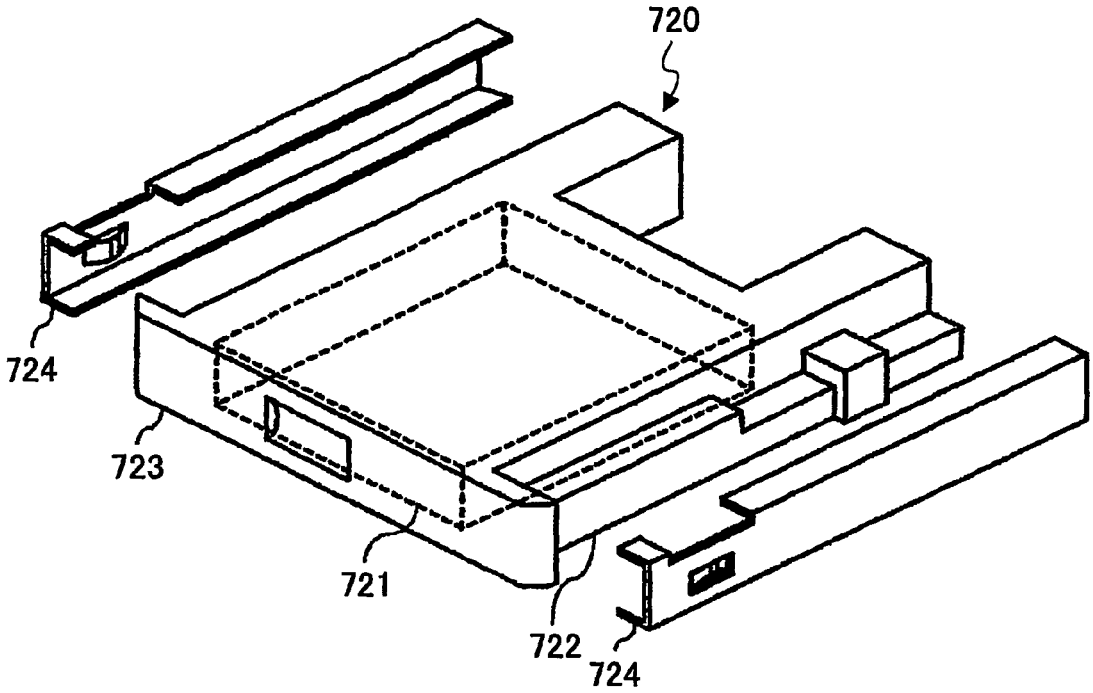
FIGS. 11A and 11B are an elevation view and a top view of a tray-shaped secondary power supply according to an embodiment.
Figure 11B:
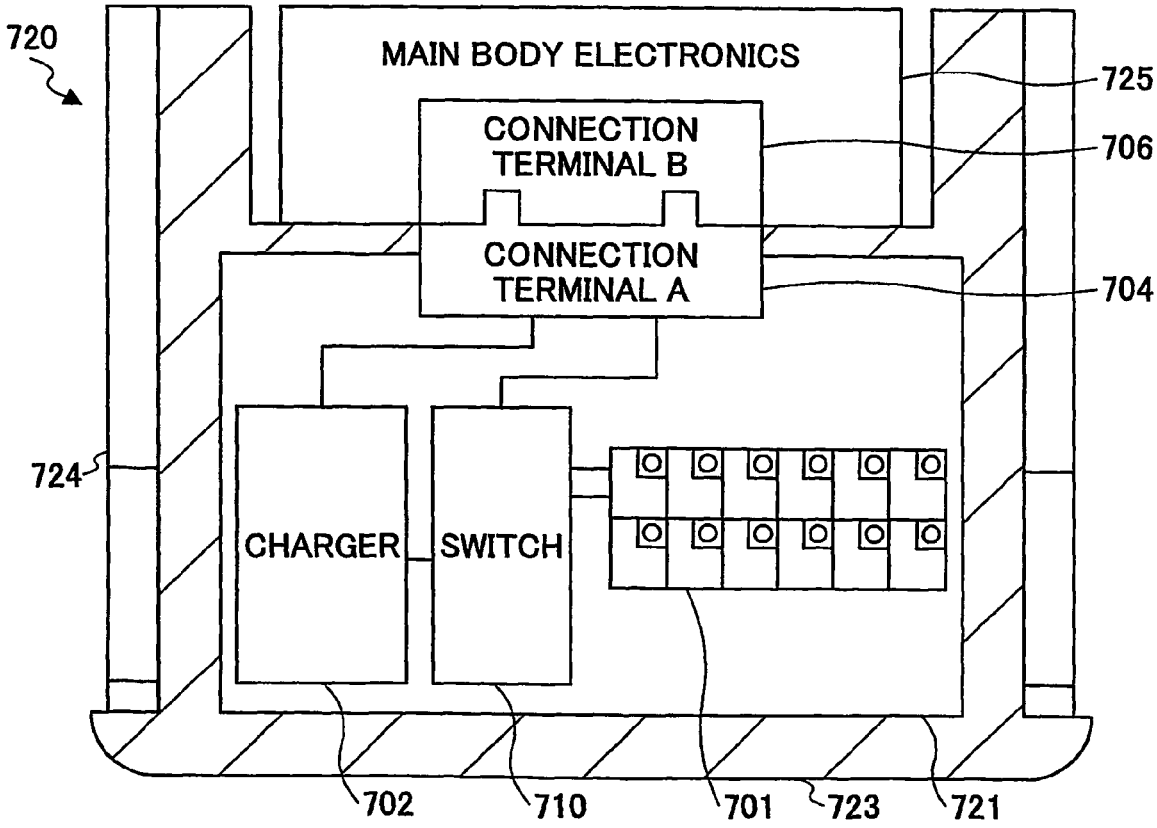

As shown in the side cross-sectional view in FIG. 10, the secondary power supply 720 may be disposed in a space formed by removing the paper feed tray 101 from the image forming apparatus 1. As shown in the elevational view in FIG. 11A, the facing of the secondary power supply 720 is structured by an insulating member 723 made of mold resin, and is tray-shaped. A storage space 721 is provided therein and covered by the insulating member 723. Storage salients 722 are formed on the side of the insulating member 723 as blocks. The secondary power supply 720 can be loaded along guide rails 724 in the paper feed unit 10 provided for the paper feed tray 101. The secondary power supply 720 can be stored in the paper feed unit 10 as a replacement of the paper feed tray 101. As shown in the top view in FIG. 11B, the capacitor 701, the charger 702, and the switch 710 are stored in the storage space 721 of the insulating member 723. The connection terminal "A" 704 protrudes from the back side of the insulating member 723. When the secondary power supply 720 is loaded in the paper feed unit 10, the connection terminal "A" 704 is connected to the connection terminal "B" 706 provided on the main body electric unit 725 on the back side of the paper feed unit 10. As a result, the secondary power supply 720 and the fixing unit 5 are electrically connected. The secondary power supply 720 is fixed on a base unit 12 with screws, for example, so that the user does not touch the interior of the secondary power supply 720. The mechanical strength of the facing may be improved by metal members such as aluminum plate or sheet metal. The capacitor 701 may be covered alone by the insulating member 723. The ventilation aperture 707 and the fan unit 708 may be provided on the insulating member 723.

The second power supply 720 may be disposed under the fixing unit 5 and further under the partitioning plate 11, so that the heat generated by the fixing unit 5 does not affect the second power supply 720. At the same time, even if the fixing unit is rapidly heated immediately after the image forming apparatus 1 is turned on, the moisture is prevented from condensing on the secondary power supply 720. It is not necessary to provide additional space for the capacitor 701, and as a result, the image forming apparatus 1 can be made compact. Even if an image forming apparatus is initially not provided with the secondary power supply 720, the secondary power supply 720 can be installed afterward using common chassis and components.

Figure 12:
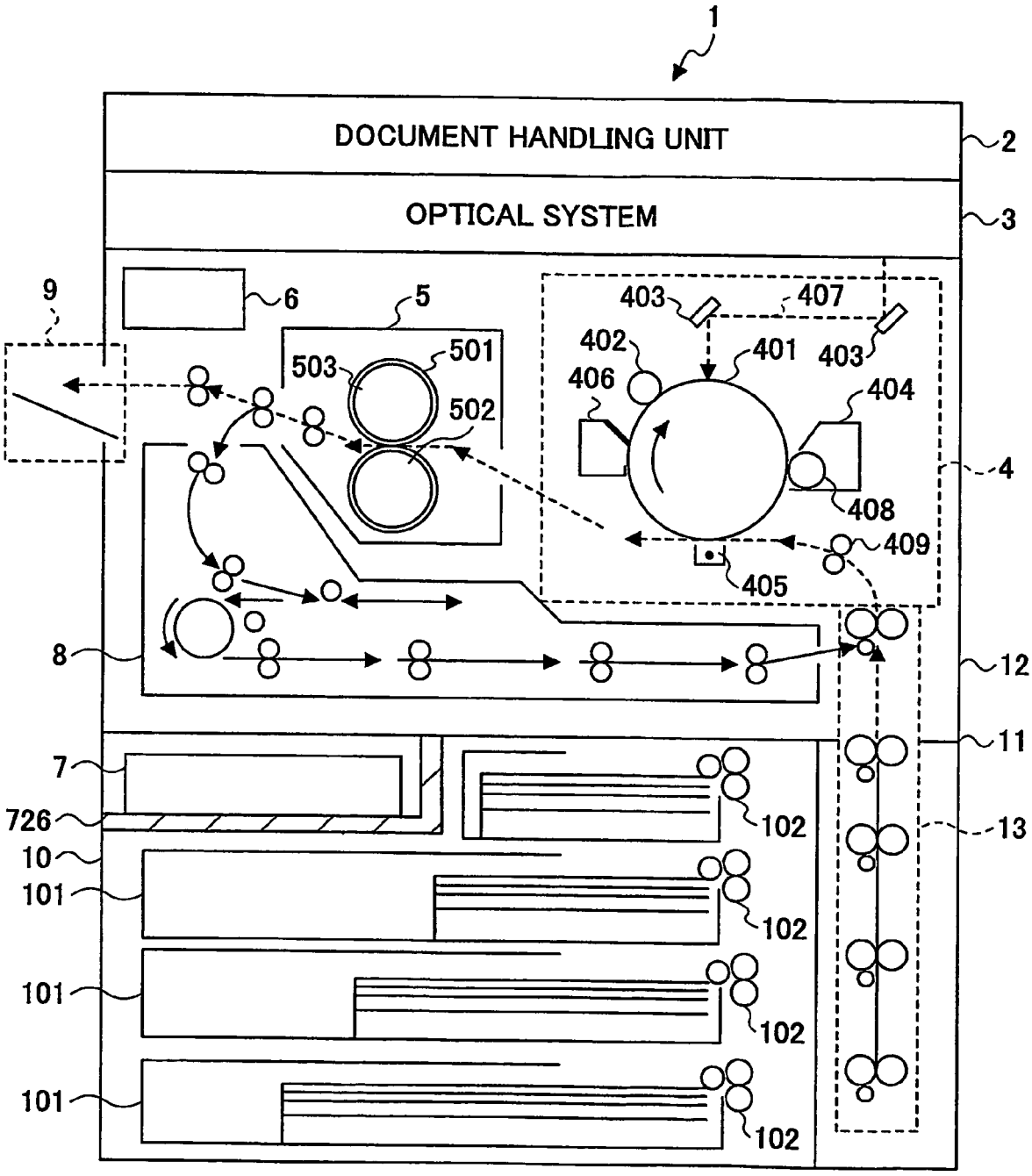
FIG. 12 is a side cross-sectional view showing the disposition of a secondary power supply in a paper feed unit according to another embodiment.
Figure 13:
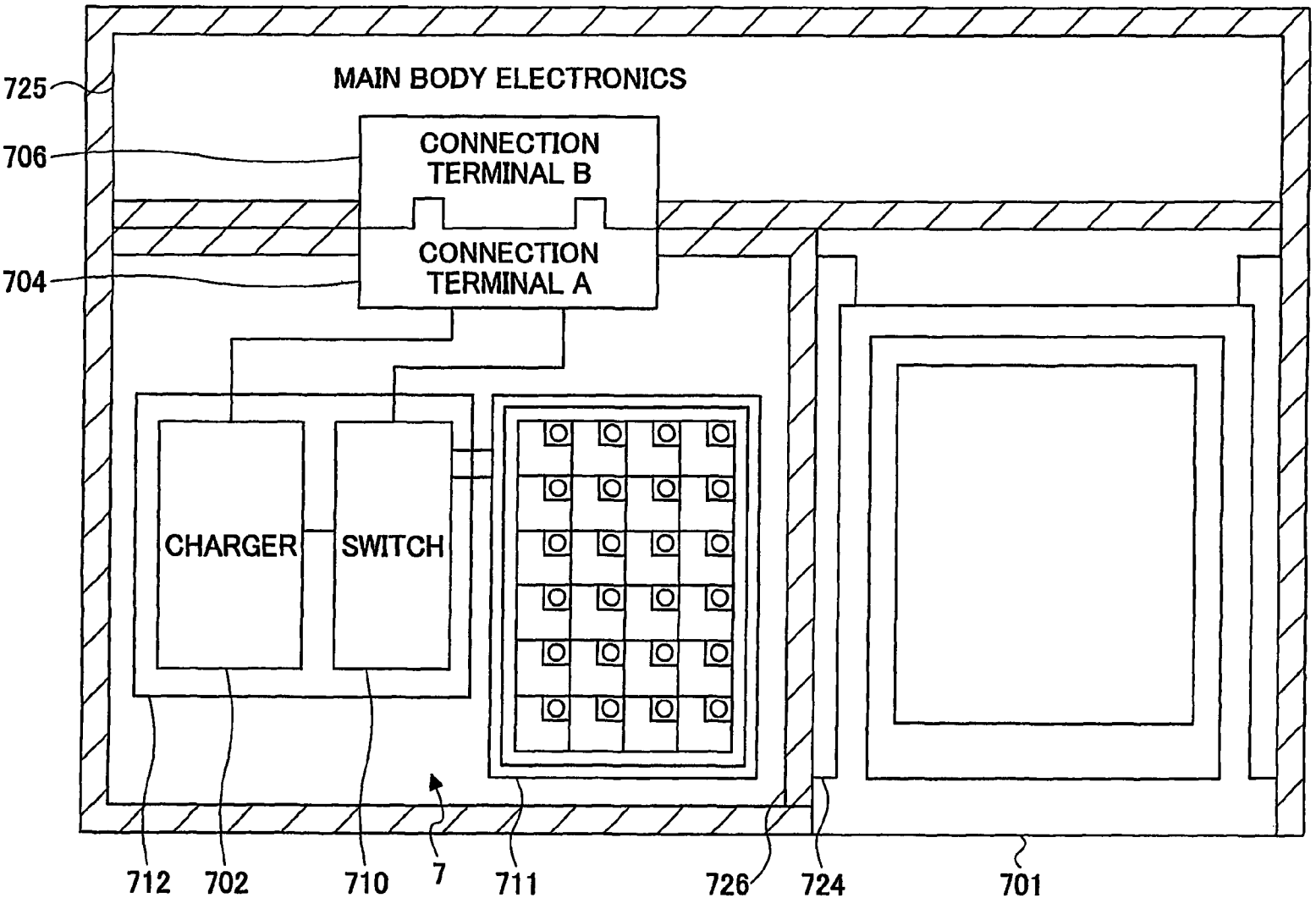
FIG. 13 is a top cross-sectional view showing the disposition of a secondary power supply in a paper feed unit according to yet another embodiment.

As shown in the side sectional view in FIG. 12, the secondary power supply 7 may be disposed in a space covered by a partitoning plate 726, the space being separated by the partitioning plate 11 of the paper feed unit 10, the paper feed tray 101, and the back face wall 714. In the case where the image forming apparatus has a space for storing A3 sized plain paper therein, but only A4 sized plain paper that is used more often is stored in the image forming apparatus, there may be idle space in the paper feed unit 10. The secondary power supply 7 may be disposed in the idle space so that the space in the image forming apparatus can be used efficiently, and the image forming apparatus may be made compact. At the same time, the effect of the heat generated by the fixing unit 5 can be reduced, and moisture is prevented from being condensed due to rapid heating of the fixing unit 5 immediately after the starting-up. As shown in the top view of FIG. 13, a guide rail for the paper feed tray may be provided on the partitioning plate 726 so that the paper feed tray 101 can be loaded as well. The second power supply 7 may preferably be separated into the capacitor module 711 and the secondary power supply circuit 712, and the capacitor module 711 is insulated from the heat generated by the secondary power supply circuit 712.

Figure 14:
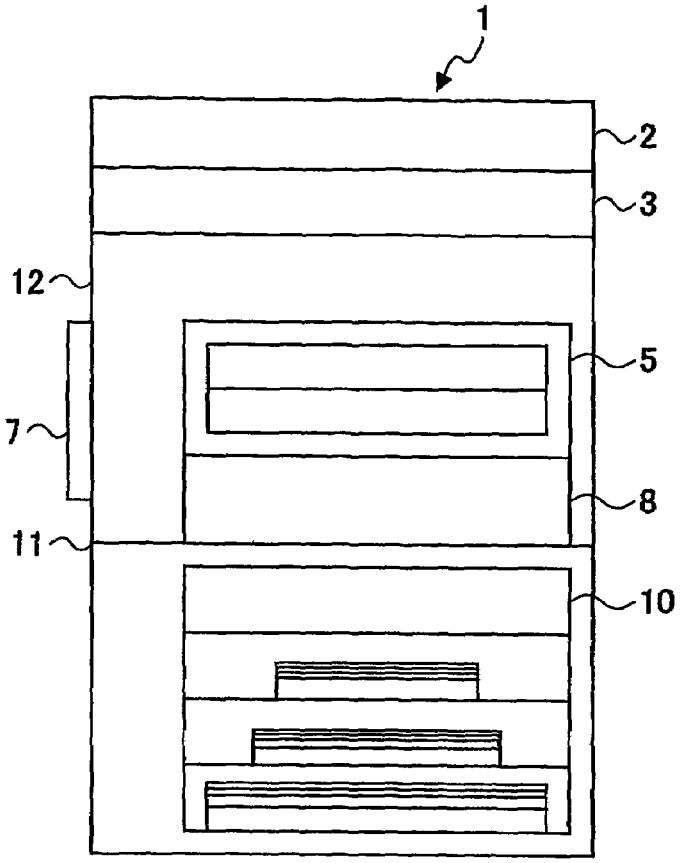
FIG. 14 is a rear view showing the disposition of a secondary power supply according to an embodiment.
Figure 15:
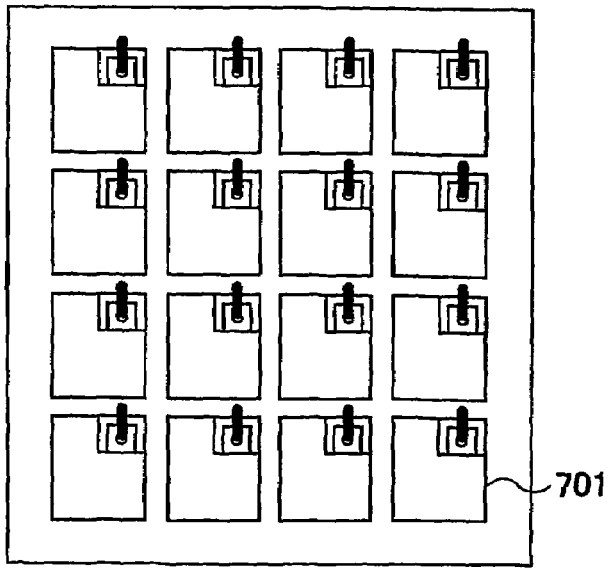
FIG. 15 is a schematic diagram showing the configuration of a capacitor according to an embodiment.

As shown in FIG. 14, the secondary power supply 7 may be disposed on the external back face of the image forming apparatus 1. As shown in FIG. 15, the capacitor 701 may be formed in a flat-plate manner, the depth of the image forming apparatus may be prevented from increasing. For example, the flat plate may be 30 cm long×30 cm wide×5 cm deep, for example. Since the secondary power supply 7 is disposed in the exterior of the image forming apparatus 1, the capacitor may not be affected by the temperature in the image forming apparatus 1 or the heat generated by the fixing unit 5. The capacitor becomes durable, and moisture condensation due to rapid heating of the fixing unit 5 immediately after the starting-up can be avoided.

The present invention is applicable to electrophotography type image forming apparatuses and any other apparatuses having a heating unit using electricity as the major source of energy.

The preferred embodiments of the present invention are described above. The present invention is not limited to these embodiments, but various variations and modifications may be made without departing from the scope of the present invention.

This patent application is based on Japanese Laid-Open Patent Applications No. 2003-290108 filed on Aug. 8, 2003, and No. 2004-209309 filed on Jul. 16, 2004, the entire contents of which are hereby incorporated by reference.

The invention claimed is:

1. An image forming apparatus, comprising:

a fixing unit that fixes a toner image transferred to paper, said fixing unit including a plurality of heaters;

a main power supply that provides a portion of the heaters with voltage;

a secondary power supply that provides another portion of the heaters with power charged by said main power supply; and a heat insulation member disposed between said fixing unit and said secondary power supply;

wherein said secondary power supply is disposed below and in the neighborhood of said fixing unit; and a wire of AWG 14 or thicker is used for connecting said secondary power supply and the heaters.

2. The image forming apparatus as claimed in claim 1, further comprising:

an insulation member disposed so as to cover said secondary power supply.

3. The image forming apparatus as claimed in claim 1, wherein said secondary power supply comprises a secondary power supply circuit and a capacitor, and the capacitor is covered by said insulation member.

4. The image forming apparatus as claimed in claim 1, further comprising a discharging unit that discharges a charge stored in the secondary power supply when said secondary power supply is being maintained or replaced.

5. The image forming apparatus as claimed in claim 1, further comprising a switch unit that switches on and off electrical connection between said secondary power supply unit and a ventilation unit for generating air flow in and around said secondary power supply.

6. The image forming apparatus as claimed in claim 1, further comprising a cooling unit that cools an interior of said secondary power supply.

7. An image forming apparatus, comprising:

a fixing unit that fixes a toner image transferred to paper, said fixing unit including a plurality of heaters;

a main power supply that provides a portion of the heaters with voltage;

a secondary power supply that provides another portion of the heaters with power charged by said main power supply; and a heat insulation member disposed between said fixing unit and said secondary power supply;

wherein said secondary power supply is disposed between a side face of a chassis of the image forming apparatus and said fixing unit, or on the surface of the chassis of the image forming apparatus; and a wire of AWG 14 or thicker is used for connecting said secondary power supply and the heaters.

8. The image forming apparatus as claimed in claim 7, further comprising a secondary power supply which comprises:

a first connection terminal provided on the chassis of the image forming apparatus; and a second connection terminal provided on the secondary power supply, wherein one of the first connection terminal and the second connection terminal are male and the other is female.

9. The image forming apparatus as claimed in claim 7, further comprising:

an insulation member disposed so as to cover said secondary power supply.

10. The image forming apparatus as claimed in claim 7, wherein said secondary power supply further comprises a secondary power supply circuit and a capacitor, and the capacitor is covered by said insulation member.

11. The image forming apparatus as claimed in claim 7, further comprising:

a first connection terminal provided on the chassis of the image forming apparatus; and a second connection terminal that is electrically connected to said second power supply, said second connection terminal being connectable to said first connection terminal.

12. The image forming apparatus as claimed in claim 11, wherein said first connection terminal and said second connection terminal are detachable.

13. The image forming apparatus as claimed in claim 2, wherein said secondary power supply further comprises:

a capacitor; and a discharging unit that discharges a charge stored in said capacitor when said secondary power supply is being maintained or replaced.

14. The image forming apparatus as claimed in claim 7, wherein said secondary power supply further comprises:

a capacitor of a high capacity; and a switch unit that switches on and off a ventilation unit for generating air flow in and around said secondary power supply.

15. The image forming apparatus as claimed in claim 7, wherein a wire of 14 or more in AWG size is used for connecting said secondary power supply and the heaters.

16. The image forming apparatus as claimed in claim 7, wherein said secondary power supply further comprises a cooling unit that cools an interior of said secondary power supply.

17. The image forming apparatus as claimed in claim 7, further comprising:

a discharging unit that discharges a charge stored in the secondary power supply when said secondary power supply is being maintained or replaced.

18. The image forming apparatus as claimed in claim 7, further comprising:

a switch unit that switches on and off electrical connection between said secondary power supply unit and a ventilation unit for generating air flow in and around said secondary power supply.

19. The image forming apparatus as claimed in claim 7, further comprising:

a cooling unit that cools an interior of said secondary power supply.

20. An image forming apparatus, comprising:

a fixing unit that fixes a toner image transferred to paper, said fixing unit further having a plurality of heaters;

a main power supply that provides a portion of the heaters with voltage;

a secondary power supply that provides another portion of the heaters with power charged by said main power supply; and a paper feed unit to which a plurality of paper feed trays for storing the paper are loadable;

wherein said secondary power supply is disposed as a portion of said paper feed unit.

21. The image forming apparatus as claimed in claim 20, further comprising:

an insulation member disposed between said fixing unit and said secondary power supply.

22. The image forming apparatus as claimed in claim 20, further comprising:

an insulation member disposed so as to cover said secondary power supply.

23. The image forming apparatus as claimed in claim 20, wherein said secondary power supply further comprises a secondary power supply circuit and a capacitor, and the capacitor is covered by said insulation member.

24. The image forming apparatus as claimed in claim 20, further comprising:

a first connection terminal provided on the chassis of the image forming apparatus; and a second connection terminal that is electrically connected to said second power supply, said second connection terminal being connectable to said first connection terminal.

25. The image forming apparatus as claimed in claim 24, wherein said first connection terminal and said second connection terminal are detachable.

26. The image forming apparatus as claimed in claim 20, wherein said secondary power supply further comprises:

a capacitor; and a discharging unit that discharges a charge stored in said capacitor when said secondary power supply is being maintained or replaced.

27. The image forming apparatus as claimed in claim 20, wherein said secondary power supply further comprises:

a capacitor of a high capacity; and a switch unit that switches on and off a ventilation unit for generating air flow in and around said secondary power supply.

28. The image forming apparatus as claimed in claim 20, wherein a wire of 14 or more in AWG size is used for connecting said secondary power supply and the heaters.

29. The image forming apparatus as claimed in claim 20, wherein said secondary power supply further comprises a cooling unit that cools an interior of said secondary power supply.

* * * * *